United States Patent [19]

McInerny et al.

[11] 4,253,651

[45] Mar. 3, 1981

[54] DOCUMENT INTERLEAVER DEVICE

[75] Inventors: George P. McInerny, Andalusia, Pa.; Aaron F. Parker, Elm, N.J.

[73] Assignee: Technitrol, Inc., Philadelphia, Pa.

[21] Appl. No.: 7,928

[22] Filed: Jan. 30, 1979

[51] Int. Cl.[3] ..... B65H 39/04

[52] U.S. Cl. ..... 270/58

[58] Field of Search ..... 270/58; 271/122, 119, 271/125, 41

[56] References Cited

U.S. PATENT DOCUMENTS

| | | | |
|---|---|---|---|
| 2,445,636 | 7/1948 | Rubidge et al. | 270/58 |
| 3,191,746 | 6/1965 | McBride | 270/58 |
| 3,356,361 | 12/1967 | Geisler et al. | 270/58 |
| 3,466,026 | 9/1969 | Heigl | 270/58 |
| 3,559,982 | 2/1971 | Eppers | 270/58 |
| 3,652,078 | 3/1972 | Sather | 270/58 |
| 3,685,819 | 8/1972 | Deutsch | 270/58 X |
| 4,174,829 | 11/1979 | McCain | 270/58 X |

*Primary Examiner*—Robert E. Bagwill

*Attorney, Agent, or Firm*—John C. Dorfman

[57] ABSTRACT

A device for handling documents which operates to interleave or intermix documents from separate stacks in accordance with a predetermined pattern. The documents are fed through the machine preferably so as to be visible and retrievable throughout their travel. The machine includes an inspection station where the documents are overlapped to permit visual inspection of at least one edge portion of each separate document. The documents from separate stacks are fed one-by-one through separate feed paths with means for insuring single-document feed and means for counting prior to merger and discharge of the merged documents.

24 Claims, 11 Drawing Figures

DOCUMENT INTERLEAVER DEVICE

The present invention relates to a device for handling documents and in particular for interleaving or intermixing documents from separate stacks in accordance with a predetermined pattern. The invention also provides counter means for counting and displaying a count of the number of documents selected from the separate stacks and the total number of documents.

BACKGROUND OF THE INVENTION

Various situations exist where it is desirable to mix or interleave documents and various types of mechanisms capable of interleaving or collating documents are available. These devices tend to be bulky and associated with machines such as document copiers. These devices, however, are not suitable for high reliability applications, such, for example, as where paper currency is to be interleaved, which must be done with precision and an accurate count provided. The problem is particularly severe in situations where new "brick" currency is to be introduced into circulation. Banks and department stores are frequently the focal points of such problems. The banks are required by charter, among many other responsibilities, to place new money into circulation.

Bank cashiers and tellers have a particularly difficult time handling new currency, and bank patrons receiving the new currency may have problems as well. Various studies have been made about the problem, and it has been estimated that bank personnel counting new currency may be slowed at least 15 times the normal rate because of the tendency of the new currency to stick together. Not only is the initial counting slow, but repeated counting is necessary to avoid mistakes and loss of money. Frequently, too, the best and most reliable personnel in the bank is assigned to do this kind of work because of the importance of avoiding mistakes. Handling the new money is also a problem in that its sharp edges can result in cuts to the hands and fingers of persons handling it. The resulting increased handling on the part of the teller also causes delays which are a further cause of dissatifaction with bank service.

One way of minimizing the complaint of patrons is for a teller or cashier to hand out a combination of new and used money. Frequently, old money is interleaved between the new on a second count. Heretoforth is has been a hand operation which is tedious and time consuming.

THE NATURE OF THE INVENTION

The present invention provides for the first time a document interleaving device that is capable of interleaving various types of documents, but is particularly useful for interleaving new currency with used currency. There is presently no known device which will reliably do this job.

The present invention is directed to a device which is quiet, compact, and is simple to operate and which preferably provides fail-safe operation. Thus, it can be used at a teller's or cashier's work station without occupying undue space, producing distracting noise, or complicating the teller's work. The device operates at high speed, conservatively accomplishing the job 15 times faster than it can be done by hand. It can be made extremely accurate by the inclusion of a single sheet stripper such as is disclosed in the U.S. patent application of George P. McInerny, Ser. No. 869,663, filed Jan. 16, 1978, in each of the document flow paths for each of the stacks of currency employed.

In addition to being useful as an interleaver, the device is capable of being used as a straight counter of currency, and, hence, can serve both functions.

The present invention also makes it possible with currency and other documents which should be inspected to provide an overlapping output whereby the operator can inspect to see differences in the documents, such as a mistake in the insertion of bill of the wrong denomination or even a piece of paper which is not currency, which has inadvertently, or intentionally, been inserted in the stack.

The present invention is also capable of use for non-currency applications, and, in such applications, it may interleave from more than two stacks and in various patterns and sequences according to some predetermined logic. The device will find particular applications where its compactness and quietness are an advantage. It also is not subject to error due to wear and provides easy low cost maintenance.

More specifically, in accordance with the present invention, a device for interleaving documents is provided. Included are document bins for receiving stacks of each of the documents to be interleaved. Means defining separate feed paths extend from and direct documents from each of the document bins to a merger point. A merged feed path subsequent to the merger point connects the separate feed paths to a common collection bin. Each of the respective feed paths has at least a single document separation means along its length in defining at least part of the path to assure that no more than one document moves along its feed path at one time. Document sensing means is provided along each document feed path after the document separation means to detect when a document has passed through the single document separation means. Drive means is provided for each separate feed path driving at least the single document separation means. Means is provided to activate the respective drive means in sequence, including logic means responsive to the document sensing means for predetermined sequential activation of the respective drive means so that only one document passes through a selected one of the document paths to the merger point at a time, whereby documents from the respective document bins are interleaved in a predetermined sequence.

Counters are preferably provided in each of the separate feed path after the single document separation means, in order to give a count of documents which have passed the single document separation means. Display means related to the counter means may give counts for the number of document separated from each of the document bins and may also give a cumulative total. It is possible as well to have sensing means along the feed paths to detect when the bins are empty. This can be done at various stages by suitable techniques, but preferably is done at a point where the documents are continuously fed through the device by detecting a discontinuity in flow.

The structure of the device of the present invention has unique features including a reference deck which is preferably tilted from the vertical plane. A second parallel deck allows double deck bearing support for the rotating members, support for drive structure and various techniques for supporting guide members. In addition, the present invention provides a means for displaying the bills as they are passed through the device so that each of the documents passing through the device may be seen and identified visually. This includes a feed means which spaces the leading edge of successive documents from the previous leading edge. This is particularly important for money handling application to permit visual confirmation of genuine bills of proper denomination.

SPECIFIC DESCRIPTION OF AN EMBODIMENT OF THE PRESENT INVENTION

For a better understanding of the present invention, a preferred embodiment is shown in the accompanying drawings in which.

Figure 1:
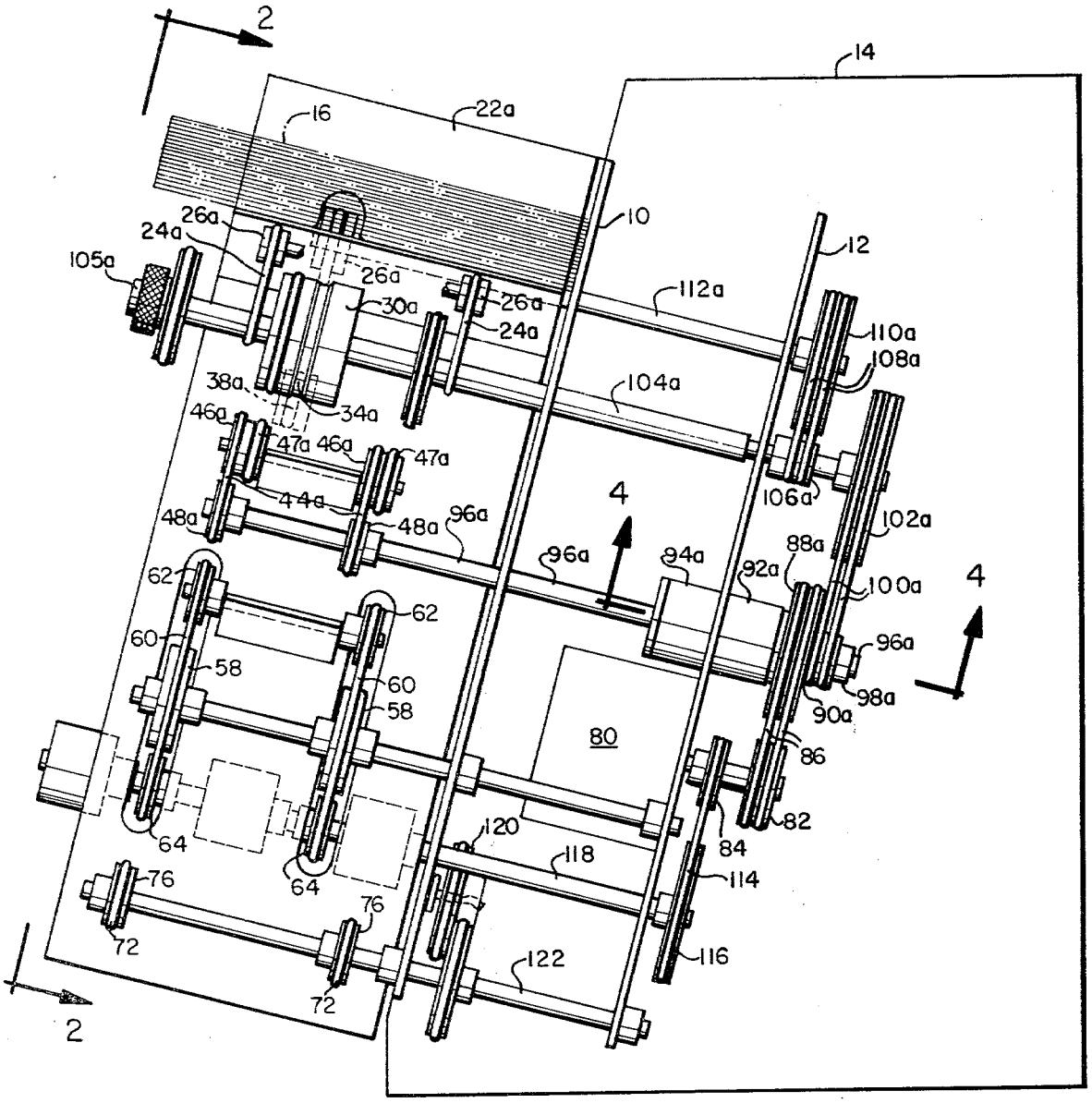
FIG. 1 is a side elevational view of a document interleaver device of the present invention.

Referring first to FIG. 1, the structure of the device of the present invention is supported on a frame member consisting of two parallel decks. The reference deck 10 is spaced from, but parallel to, secondary deck 12. Spacing columns and other mechanical structure providing interconnection and rigid support between these two decks is omitted from the drawing for the sake of clarity and to avoid confusion with the operating structure. However, it will be understood by those skilled in the art that such connections, which are entirely conventional, are provided. The frame is supported through reference deck 10 within a cabinet 14, the outline of which is shown in phantom. Cabinet 14 contains the power supply and certain circuitry as well as providing a base for support of the device. In a preferred embodiment, the deck 10 is snuggly received within a rectangular opening and a lip of the cabinet which extends inwardly and terminates in a flange parallel to the cabinet face through which the opening extends. This flange provides a positioning stop for reference deck 10. Preferably a reinforced member is added to it or part of the flange to enable the reference deck 10 to be bolted into place on the cabinet. It will be observed that the cabinet face through which the device extends is tilted at an angle to the vertical, which angle, in the embodiment shown, is approximately 15°, and the cabinet supports the device in this position. The slight angle of the reference deck from vertical causes documents placed in the bins and moving through the feed paths to have one edge held in index by gravity against the reference deck 10. This is because the bins are arranged perpendicular to the reference deck.

Figure 2:
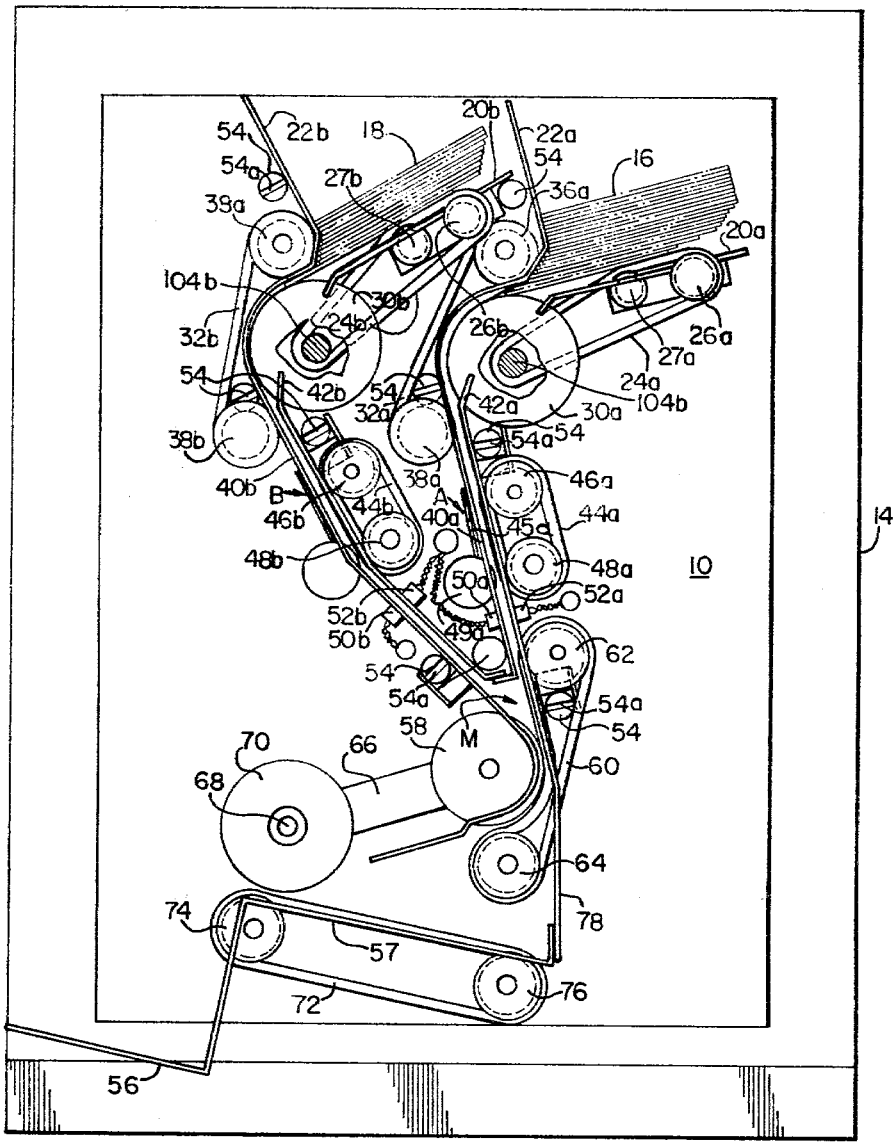
FIG. 2 is a plan view of the document handling portion of the present invention taken along line 2—2 of FIG. 1.

FIG. 2 is a plan view looking squarely into the reference deck 10 from the side on which the document processing structure of the system is located. The device shown is a device which is particularly useful in banks and other locations handling new money and is useful for interleaving new money with old, or individual documents from one stack 16 with those from another stack 18. It will be appreciated that the documents in stack 16 and 18 pass along document feed paths, generally designated A and B, which are functionally identical. Therefore, in describing them, corresponding structure related to the two feed paths will be described together and are given the same number designator with the addition of an "a" or "b" suffix.

Figure 3:
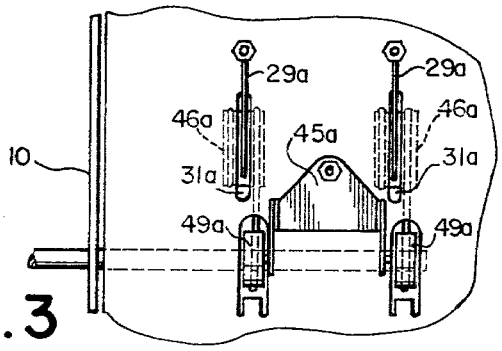
FIG. 3 is a partial view showing detail of some of the guide structure seen in FIG. 2.

The bins in which the documents 16 and 18 are loaded consist of a support platform 20*a*, 20*b* somewhat downwardly inclined from the horizontal toward reference deck 10 and toward the feed path as well to aid by gravity indexing as well as the movement of the documents into their respective paths. The document stack has its movement limited toward its associated path, however, by wall 22*a*, 22*b*, normal to the reference deck and generally normal to the support platform. The bottom of wall 22*a*, 22*b* is bent slightly in the direction of movement of the documents and the wall is terminated above the support slide 20*a*, 20*b*. Extending through each of the support slides 20*a*, 20*b* are a pair of resilient belts 24*a*, 24*b* which engage the bottom document on each of the stacks 16 and 18. Each of the belts is driven by a drive shaft 104*a*, 104*b*, around which it passes, and passes over path defining pulley 27*a*, 27*b* and 26*a*, 26*b*, (see FIG. 2) on a common shaft with the friction drum of the sheet separator to be described. The direction of rotation is such as to move the sheet toward the frictional drum 30*a*, 30*b* and into a nip between it and a counter-rotating belt 32*a*, 32*b*. The counter-rotating belt bears against a freewheeling pulley 34*a*, 34*b* which deflects it from its path between its pulleys 36*a*, 36*b* and shaft 104*a*, 104*b*. The documents are guided by sheet metal guide walls or guards 40*a*, 40*b* on one side, and 42*a*, 42*b* on the other. Counter rotating belts 32*a*, 32*b* extend through operational slots through guides 40*a*, 40*b*. Similarly, acceleration friction belts 44*a*, 44*b* carried on pulleys 46*a*, 46*b* and 48*a*, 48*b* are provided slots through guide 42*a*, 42*b*. As seen in FIG. 3, spring members 29*a*, 29*b* are supported on guide 40*a*, 40*b* extend through slots 31*a*, 31*b*, respectively, to urge documents into belts in 44*a*, 44*b* as they pass over pulleys 46*a*, 46*b*. Guide 40*a*, 40*b* also supports a pressure plate 45*a*, 45*b* which rotatably supports the axle for rollers 49*a*, 49*b* which is urged through openings in guide 40*a*, 40*b* against the pulleys 48*a*, 48*b* to insure adequate feed pressure in this area. The guide 40*a*, 40*b* also supplies support for photoelectric pick-ups 50*a*, 50*b* and guides 42*a*, 42*b* supply support for light source 52*a*, 52*b* which normally illuminate the photo pick-ups 50*a*, 50*b*. Sheet metal guides themselves are supported from the wall 10 in a manner which will be described in greater detail by similar support posts 54.

The document feed paths A and B merge at merge point M at the beginning of a merged feed path, ultimately terminating in a collection bin 56, a right angle formed sheet metal member affixed perpendicularly to the reference deck 10. Intermediate the collection bin is an intermediate examination deck 57 preferably an integral sheet metal part of bin 56 and over which the documents pass in a fanned out arrangement as will be discussed hereafter. The merge point leads into the nip between rollers 58 and belts 60. Belts 60 are each supported between a pair of pulleys 62 and 64 and each roller 58 deflects one of the belts 60 from its straight line path between the pulleys. The same shaft which supports rollers 58 supports one end of beams 66, which rotatably support their other end axle 68 and the support roller 70. Roller 70 is opposed to the conveyor belts 72 adjacent that end where they are supported on pulleys 74. The belts 72 extend between pulleys 74 on one end and pulleys 76 on the other. A sheet metal guardwall 78 extending upward from deck 57 prevents the inadvertent loss of documents. The extension of wall 78 is wall 42 which defines one of the boundaries of the mixed document path and, above that, of path A.

The operation of the device may be understood by reference to FIG. 2. First it should be explained when paper money is sorted the stacks 16 and 18 on decks 20*a* and 20*b* places the narrow end edge of the bills against reference deck 10. Preferably the bills overhand the edges of decks 20*a* and 20*b* and throughout the system extend beyond the guide walls so that they may be manually pulled from the machine if necessary.

As will be later explained, when the drive means of the sheet preparation means 30*a*, 32*a* of devices along path A is operating, the drive means of the sheet separation device 30*b*, 32*b*, of feed path B, is shut down. The bottom bill or document from stack 16 is moved along by conveyor belts 24*a* into the nip of the sheet separating means 30*a*, 32*a* so that only a single bill or document is taken and it is moved through the sheet separating means and guided by guide walls 40*a* and 42*a* to the acceleration belt 44*a* which is running at high speed and will tend to pull the bill or document out of the sheet separation means.

When the document reaches the photo-detector 50*a*, it will block it off from light 52*a* causing the detector to generate a pulse which may be used as a count of the document moving down path A and also signals the shut down of the drive along path A and the start up of the drive of path B. When the drive of path B is activated, conveyor 24*b* moves the document into single sheet separation means 30*b*, 32*b*, thence, down between guides 40*b*, 42*b* past acceleration rolls 44*b* and photodetector 50*b*, causing the document to be counted and the drive along path A reactivated.

Figure 5:
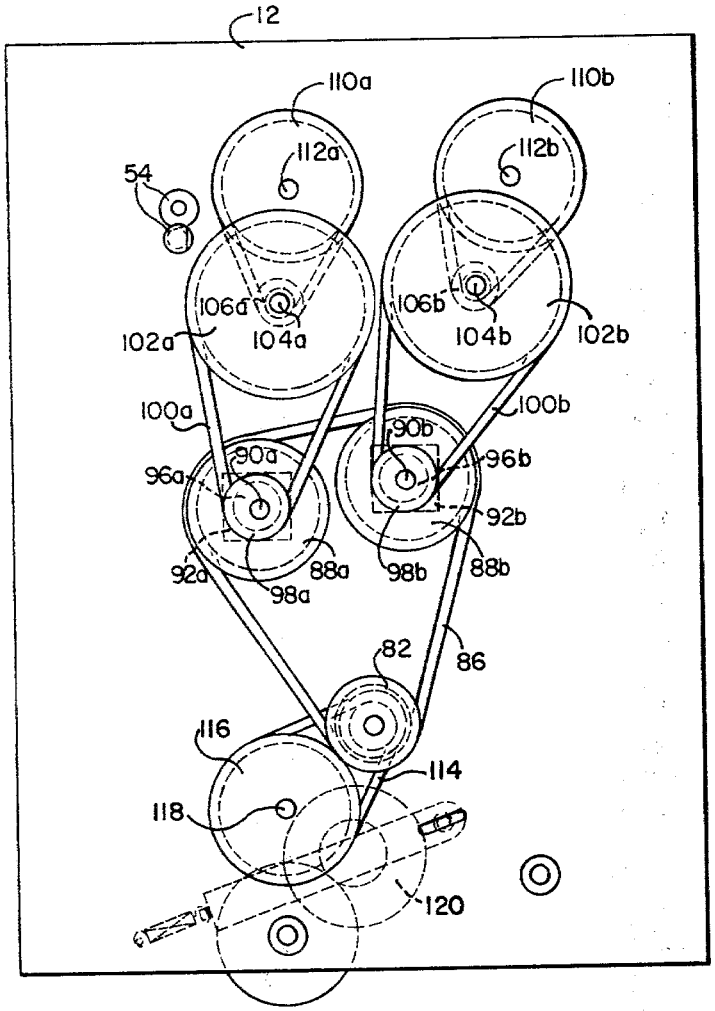
FIG. 5 is an enlarged view of the document collection portion of FIG. 2 showing documents being processed.

What happens following the passage beyond the merger point is best seen in FIG. 5 which shows an enlargement of the structure involved and also shows bills passing through the system. As the documents come through the point of merger M they pass between the roll 58 and the belt 60, which serves primarily to position them for the output station. These members provide a direction changing means to change documents from a position having a generally vertical to one having a generally horizontal orientation. As each document drops off of the edge of rolls 64 it is guided to assume a position on top of a stack already formed and moving slowly under the urging of belt 72 into the nip formed with roll 70. In this position, the documents are arranged with successive documents exposed for a distance predetermined by relative speed of parts of the device along its edge, whereby numbers on the notes can be identified and the document can be exposed to clearly identify it for what it is. For example, where paper currency is involved, the numbers showing denomination may be exposed.

Figure 4:
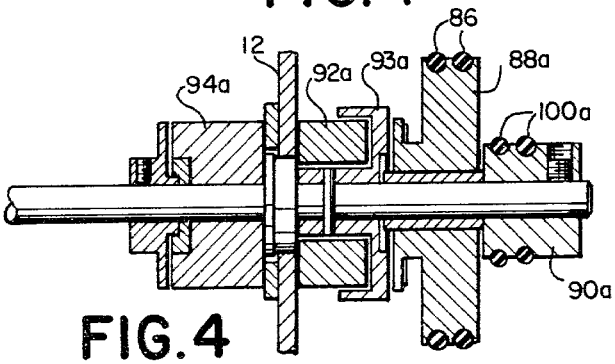
FIG. 4 is a back view of the drive system of the frame of the present invention.

Reference is now made to FIGS. 1, 4 which show the drive system of the present invention. Thus, in FIG. 1, motor 80 supported on second deck 12 with its shaft supporting pulleys 82 and 84. Pulley 82 is a double belt pulley which drives belts 86 which, in turn, drive pulleys 88*a* and 88*b*. As seen in FIG. 1 cooperating clutch 92*a* and brake 94*a* are provided on drive shaft 96*a*, which is reality two aligned shafts selectively connected or disconnected by clutch 92*a*. Similar clutch and brake structures are provided on each drive shaft. Clutch 92*b* is seen on shaft 96*b* in FIG. 5. The clutches and brakes are selected from many known types. Each clutch 92*a* and 92*b* functions to permit drive along its selected document path A or B by selectively engaging the clutches of the drive shafts 96*a* and 96*b*. Each brake functions to stop such driving when its clutch is disengaged. Such operation is conventional and the structure and operation in detail will be familiar to the man skilled in the machinery arts.

Brake winding 94*a* is supported rigidly on the housing 12 by winding support which includes angular magnetic pole piece 95*a* which attracts armature 97*a* which is supported on and connected rigidly to the shaft through spring 99*a* and a hub assembly 101*a*. The nature of the spring and hub assembly is better seen in FIG. 4*a* wherein it will be observed that the spring member 99 is a sort of spiral structure the outer ends of whose spiral arms are attached to the armature. The structure provides little yield in the rotational direction but is designed to permit movement of the supported armature relative to the shaft (or pulley 88*a*) sufficient for the structures to work. The winding 92*a* for the clutch and winding 94*a* for the brake are never energized at the same time. When the clutch is energized to achieve the position shown in FIG. 4, the brake winding is deenergized. When the brake winding is energized, the clutch winding is deenergized so that the pulley 88 remains freewheeling on its bearing on shaft 96*a* despite the fact that the shaft 96*a* has been stopped.

Drive shaft 96*a*, 96*b* preferably passes through its respective clutch and brake at the barrier provided by reference deck 10 and supports drive pulleys 48*a*, 48*b* for driving the accellerator conveyor belt 44*a*, 44*b*. A smaller pulley 98*a*, 98*b* on a coaxial extension of shaft 96*a*, 96*b* drives the double belt 100*a*, 100*b* which, in turn, drives the big double pulley 102*a*, 102*b* on shaft 104*a*, 104*b*. This shaft carries friction roll 30*a*, 30*b* and provides the center of rotation for pulleys for belts 24*a*, 24*b* and counter-rotating belt 32*a*, 32*b* (pulley 34). The clutch and brake system is such that, if shaft 96*a* rotates, 104*a* will rotate. But because pulleys 106*a*, 106*b* are mounted on shaft 104*a* and through double belt 108*a*, 108*b*, pulleys 110*a*, 110*b*, shaft 112*a*, 112*b* also is also driven in the reverse direction from the roller to drive the counter-rotating belt through pulley 36*a*, 36*b*.

In similar fashion, the shaft of motor 80 also drives a belt 114 through pulley 84. Belt 114, in turn, drives a larger pulley 116 on shaft 118. Shaft 118, in turn, drives pulleys 64 driving belt 60. Shaft 118 has a friction wheel 120 whose high frictional periphery bears against it and is thereby driven and it, in turn, drives shaft 122 carrying the pulleys 76 driving belts 72.

One of the aspects of the present invention which has separate novelty apart from the document away device, but makes the rest of the device particularly convenient to use, is the removable nature of the tray plates, stop plates and guide plates. They can be quickly removed from reference deck 10 and second deck 12 giving free access to the various conveyor belts, pulleys and rollers. One key aspect to this is making the various sheet metal pieces (i.e., 40*a*, 40*b*, 42*a*, 42*b*) in composite assemblies so that relatively few pieces need to be removed. Another feature is the support structure for these removable pieces which consist of support shafts 54. In accordance with the preferred embodiments of the invention, it is characteristic that the sheet metal structure which is cantilevered from reference deck 10 is supported by these shafts by virtue of their extension not only through support reference deck 10 but also secondary deck 12.

Figure 8:
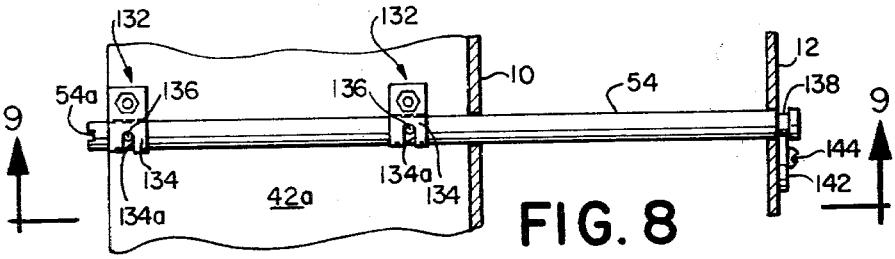
FIG. 8 is a sectional view taken along line 8—8 of FIG. 7.
Figure 7:
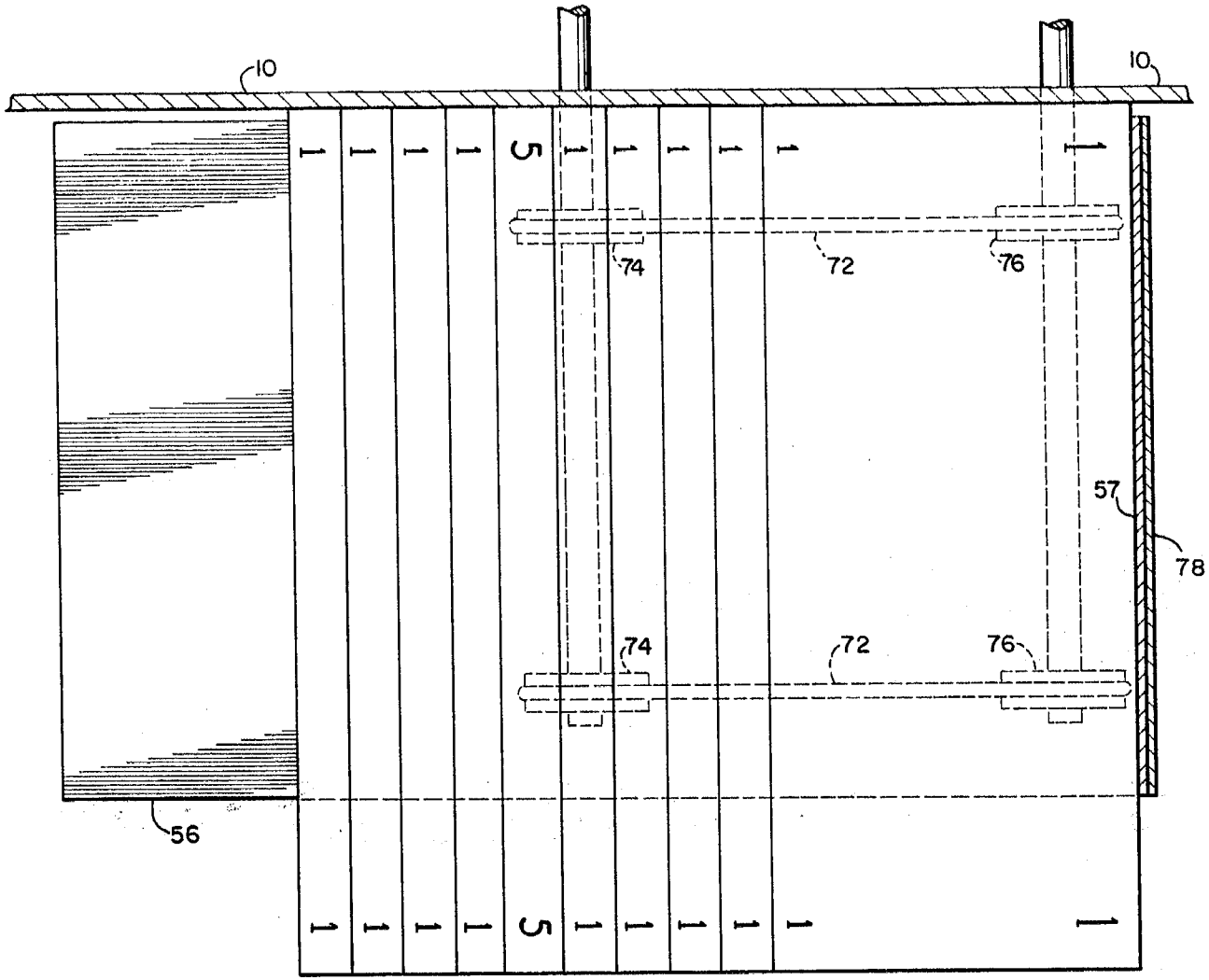
FIG. 7 is a back view of a portion of a sheet metal guide member with its support shaft in supporting position.

Although structure of the support shaft 54 have been omitted from FIG. 1 to avoid confusion with the drive shafts. The nature of the support shafts 54 can be best seen by reference to FIGS. 7, 8 and 9 which illustrate the support of guide 42*a*. As seen in FIGS. 7 and 8, each support shaft 54 penetrates reference deck 10 and secondary deck 12 to give substantial support to the cantilevered guide 42. As seen in FIG. 2, a screwdriver slot 54*a* is all that is required to provide the latching feature of the support shaft 54. The shafts are designed to penetrate both decks and receive support from them. Where more than one support shaft is employed to support a given shet metal members, ordinarily it is unnecessary to lock more than one of the shafts in place. As seen in FIGS. 7 and 8, the shafts are supported by bracket means 134 which depend upon mechanical blocks 132, stand off member whose thickness which corresponds to the diameter of shafts 54, spaces the bracket 134 from the sheet metal guide (e.g., 42*a*) providing support, the non-locking shaft 54 may simply be held in place by bracket members 134. Separate bolt means may also be used to hold a non-rotating shaft in place, since it need not rotate. However, the locking shaft 54, because of its need to rotate, must be held by brackets 134. Preferably, the brackets 134 are provided with slots 134*a* as seen in FIG. 7 to receive roll pins 136 which extend diametrically through the rotating shaft 54. This shaft is able to be rotated from the position shown in FIG. 7 a quarter of a turn. In modification, rotation may be limited by enclosing the shaft in the bracket, extending the slots in brackets 134 and making them closed at both ends to provide stops for the pins 144.

In any event, in the embodiment shown, the rotating shaft is indexed by its roll pins and trapped so that it can rotate but cannot move laterally.

Figure 9:
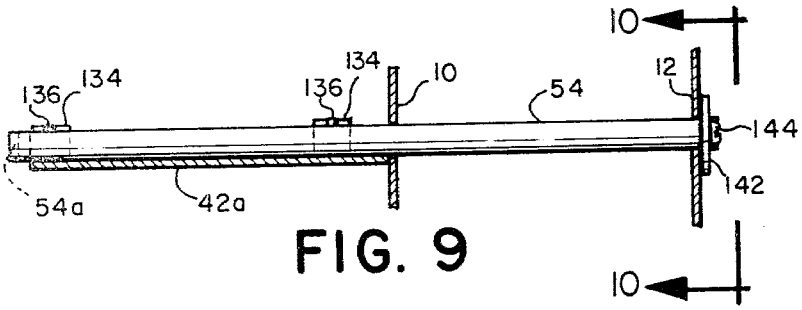
FIG. 9 is a detailed view taken from the back showing the locking feature of the support shaft of FIGS. 7 and 8 viewed along line 9—9.

Locking of the rotating support post occurs because at the end of the shaft which extends beyond secondary deck 12 there is provided a circumferential groove 138 positioned so that when the shaft is fully inserted, with deck 20*a* against reference deck 10, the groove 138 lies just behind the plate 112. FIGS. 7 and 9 show the support post in locked position. By reference to FIG. 9, it will be seen that the shoulder provided by the remote sidewall of the groove 138 in the remote end of the shaft is cut away by providing a chord cut 140 tangent to the wall of the groove 138 wall. In the locked position as shown, a member 142, no thicker than the groove and conveniently a washer, is fixed by fastener 144 to the remote side of secondary deck 12 extends far enough over the edge of the bounding wall of the hole which receives support shaft 54 to engage the bottom of groove 138. Thus rotating the post a predetermined angle, here 90°, but up to 180°, counterclockwise from the position shown in FIG. 9, will bring the chord cut 140 tangent to the bottom of the groove and permit retraction of the support post 54 from deck 12 and 10. This is accomplished using the screwdriver slot 54*a* in the opposite end of the shaft to release the roll pins 136 from their positions against one end of the slots 134*a*. The reverse procedure is used in putting post 54 in place. In the procedure post 54 is positioned in a position identified by its screwdriver slot position 54*a* so that it will pass through the openings in both decks 10 and 12 and past the washer 142. The washer 142 will act as an indexing stop against the opposite uncut sidewall of channel 146 when the post is fully inserted. When indexed at that position, the post is again rotated the predetermined angle which is limited by roll pins 136 hitting the ends of slots 134*a* in brackets 134 using a quarter turn by the screwdriver slot 54*a* to return post 54 to the locked position shown in the drawings. It should be noted that the construction makes all activity associated with assembly of the sheet metal guides, and similar structure, possible from the front of the device, and outside of the cabinet.

It will be appreciated that other posts 54 in the system may be used exactly in the same way and screwdriver slots 54 or their equivalent are provided for the purpose of enabling the locking and unlocking of the post and assembly supported structure to the frame formed by decks 10 and 12 from the front of the mechanism. With but a simple twist of a screwdriver, the posts 54 are locked in place or unlocked so that the sheet metal structure which they support may be removed readily from the decks to afford easy access to the conveyor belts and pulleys.

Figure 10:
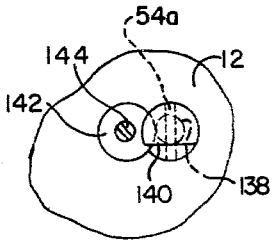
FIG. 10 is a diagrammatic view representing in combination the mechanical flow of paper and the sensing and electronic monitoring thereof leading to counts and control information.
Figure 6:
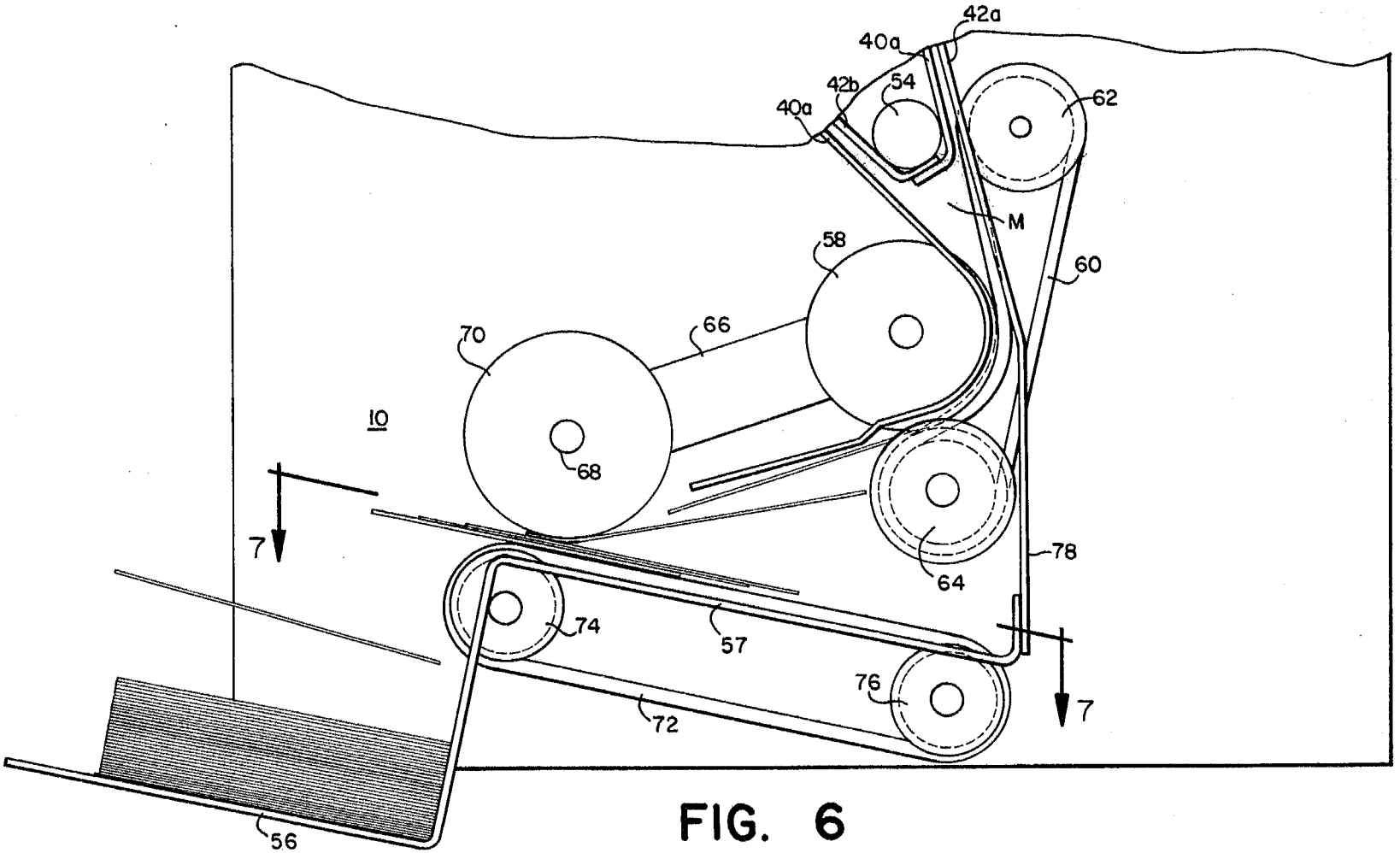
FIG. 6 is an enlarged detailed view showing documents in place viewed along line 6—6 of FIG. 5.
Figure 12:
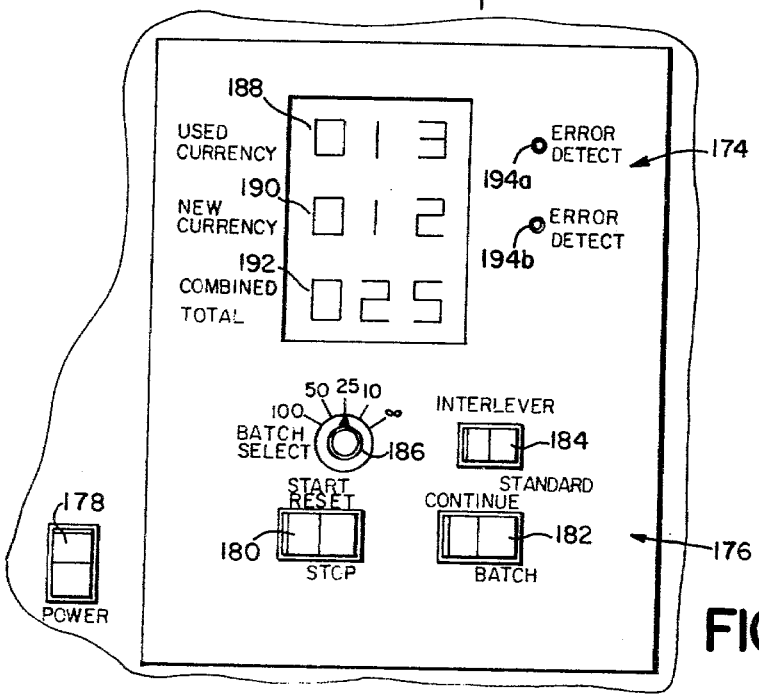

Referring now to FIG. 10, an expanded system embodying the present invention is shown represented schematically by blocks representing some of the essential elements. In the system illustrated instead of simply A and B separate document paths, there are N document paths provided, of which paths A, B, C and N are illustrated. Each of these paths has a feed bin or hopper 160*a*, 160*b*, 160*c*. . . , 160*n*, which feeds a sheet separation mechanism 162*a*, 162*b*, 162*c*. . . , 162*n*. Each sheet separator is part of a document flow path 164*a*, 164*b*, 164*c*. . . , 164*n* which feeds into a merged document flow path 166. This may occur at a point M or there may be several submerger points, providing the same effect cumulatively. Along each of these paths is a transducer 166*a*, 166*b*, 166*c*. . . , 166*n* which corresponds to the flow detector 52*a*, 52*b*. These sensors feed signals to logic 168 which may be programmable or fixed in its pattern and which, for example, may permit such things as modification of the sequence in which the documents are fed, modification of the number of documents that are fed on each occurrence, etc. Logic may also be provided to shut down in response to signals from transducers which may be photodetectors 170*a*, 170*b*, 170*c*. . . , 170*n*, which detect an absence of documents from the supply. These may be arranged through the logic as shown, or direclty, to trigger some kind of display or audible signal which may identify the particular hopper which needs additional documents. In any event, the logic would cause the equipment to shut down until the hopper is refilled. The logic operates upon feed controls including the motor clutches 94 and brakes 92, here designated feed controls 172. As documents pass through the various channels, the counter means keeps count of each document feed channel and count of each document may be displayed, as well as the total count of all documents, in display 174. The program selection 176 may allow selection of certain hoppers only, may determine the sequence of feed, set the number of documents to be fed from a particular hopper before the next hopper is called upon to supply documents, etc. These may be seen in greater detail in FIG. 12 which represents, however, the program display and program selector for the two channel embodiment shown in the other drawing.

Figure 11:
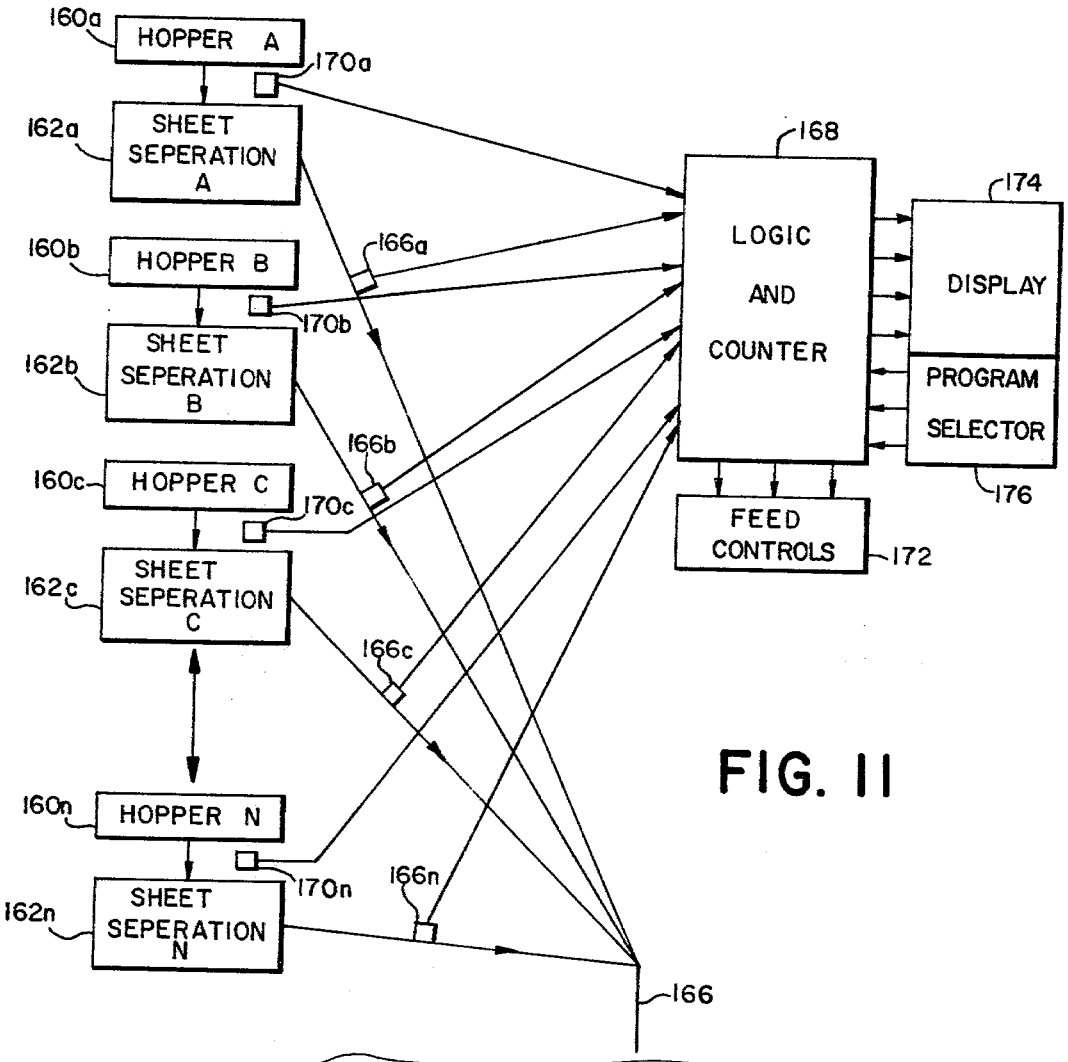
FIG. 11 is a diagrammatic showing of an output or display panel useful with the present invention.

A typical display and selection panel is shown for the two channel systems of FIGS. 1 and 5 in FIG. 11 includes a power switch 178, a combination start/reset-stop switch 180, a continue batch switch 182, a mode switch 184 and a batch select switch 186. The display portion 174 includes three related digital displays which will include the display 188 for document path A, the display 190 for document path B and combined total display 192. Additionally, error detect lights 194*a* and 194*b* signal error within the A and B document flow paths.

Switch 178 applies power to the system and particularly to the logic and counter portion 168. Switch 180 is a momentary switch. When initially depressed it grounds the counters, or otherwise causes them to reset at 0, and, therefore, displays 188, 190 and 192 reset to zero. Following this the logic permits the motor 80 to start. Thereafter, after a controlled delay, the appropriate brake and clutch will energize starting operation of the machine in program sequence. When the machine is running, switch 180 serves as a stop switch and depressing the switch will stop the motor.

Switch 184 when placed in the interleaving mode will cause a document from the stack 16 to flow from tray 20*a*, then documents 18 to flow from tray 20*b*, and continuing to alternate one bill at a time from each of the stacks when the switch 184 is put in the standard mode position. Only a document from the stack 16 in the tray 20*a* will be fed when in put from tray 20*b* is disabled. The batch select switch 186 determines the total number of documents or bills to be fed. These can be selected in finite numbers of 10, 25, 50 or 100 or show what ever other quantities may be specified for a given system. If the select switch 186 is set on the infinity position, it will continue to interleave until the documents in one of the hoppers are exhausted. Otherwise, the numbers selected on the scale setting for the switch 186 will determine the last count accepted by the counter which will also serve to shut down the system and prevent further feed.

The displays 188 and 190 give the running count of the number of documents passing the photosensors. These two figures are added to give a total in the display 192, or, alternatively, a separate photodetector may be used to make its own count after the documents are merged. In either event, the logic will cause both feed systems to be disabled before the system shuts down in order to ensure that all bills reach the output stacker.

Error detect indicators 194*a*, 194*b* are lights or LEDs that will light automatically and stop the machine process when a bill fails to pass the appropriate photosensor depending upon whether the delay or failure to feed occurs in the A or B document feed section. The logic will cause the error detector light to illuminate and at the same time stop the system, which will necessitate removing the bills from the system and starting the count again.

A preferred embodiment of the present invention in a form which has been actually built and tested has been described. By showing a system diagram in FIG. 10 which suggests variations of the theme, some of the possibilities for modification of the system have been brought out. Still others will occur to those skilled in the art.

One system for fastening sheet metal structures, including guides, in place has been described. Other systems may be used with the present invention and that particular structure described may be used for other purposes other than the interleaving device.

The appended claims are intended to set forth the bounds of the present invention. Claims are intended to include all of the structures shown and described. However, the claims apply to many more structures will occur to men skilled in the art. All such structures are intended to be within the scope and spirit of the present invention.

We claim:

1. A device for interleaving documents comprising:

separate document bins for receiving stacks of each of the documents to be interleaved;

a common collection bin;

means defining separate document feed paths from each of the document bins to a merged feed path connecting the separate feed paths to the common collection bin, each of the respective feed paths having at least single sheet counter-rotating friction separation means along its feed path;

document sensing means along each of the document feed paths after the document separation means to detect a document after it has passed through the single document separation means;

drive means for each separate feed path driving at least the single document separation means; and means to activate the respective drive means in sequence, including logic means responsive to the document sensing means for predetermined sequential activation of the respective drive means, so that only one document passes through a selected one of the separate document feed paths to the merged feed path at one time, whereby documents from the respective document bins are interleaved in the predetermined sequence.

2. The document interleaver device of claim 1 in which counter means is provided and responsive to the document sensing means to count the number of documents passing the sensing means.

3. The document interleaver device of claim 2 in which separate counter means responsive to each document sensing means is provided to count separately the number of documents passing through each document feed path.

4. The document interleaver device of claim 1 in which sensing means is provided along the separate feed paths to sense the absence of documents and provide a signal enabling the shut down of the system.

5. The document interleaver device of claim 4 in which means is provided to prevent operation of the drive means along its document feed path when the sensing means senses the absence of documents in the path.

6. The document interleaver device of claim 5 in which annunciator means is also provided to identify that bin from which documents have been exhausted.

7. The document interleaver of claim 1 in which document direction orientation means is provided after the document feed paths are merged to assure that the documents are so directed that they will fall in the same orientation onto a moving conveyor and be fanned out such that each successive document is at least a predetermined distance behind its predecessor, whereby visual inspection is facilitated.

8. The document interleaver of claim 7 in which a direction orientation means is so arranged that the documents have a major component of direction in the horizontal direction and the conveyor is generally horizontal.

9. The document interleaver of claim 8 in which the conveyor is oriented to move document in a generally horizontal position into the nip of a roller and the conveyor to pass beneath the roller which is urged into contact with documents on the conveyor to cause the documents to be overlapped and spaced at short intervals.

10. The document interleaver of claim 9 in which the roller is supported on a lever linkage which permits gravity to urge it toward the conveyor.

11. A device for interleaving documents comprising:

separate document bins for receiving stacks of each of the documents to be interleaved;

a common collection bin;

means defining separate document feed paths from each of the document bins to a merged feed path connecting the separate feed paths to the common collection bin, each of the respective feed paths having at least single sheet counter-rotating friction separation means along its feed path consisting of a friction drive cylindrical roller and a counter-rotating friction drive belt of resilient material deflected from its path and elastically deformed by the cylindrical roller and driven in opposition to the cylindrical roller by one of at least two supporting rotating members;

document sensing means along each of the document feed paths after the document separation means to detect a document after it has passed through the single document separation means;

drive means for each separate feed path driving at least the single document separation means; and means to activate the respective drive means in sequence, including logic means responsive to the document sensing means for predetermined sequential activation of the respective drive means, so that only one document passes through a selected one of the separate document feed paths to the merged feed path at one time, whereby documents from the respective document bins are interleaved in the predetermined sequence.

12. The document interleaver device of claim 11 in which friction belt feed means is provided at the bottom of each of the feed bins extending along and defining a part of each document feed path between the feed bin and the nip between the cylindrical roller and the counter-rotating belt of the document separating mechanism, said belt feed means being driven by said drive means so that the friction belt feed means pulls a document from the bin and moves it into said nip.

13. The document interleaver device of claim 11 in which common motor means is provided for each of the drive means along a given document path.

14. The document interleaver device of claim 13 in which the common motor means which drives the entire device is selectively connectable to drive each of the drive means along each of the document feed paths and separate clutch means for each of the drive means with actuator means provided to be actuatable to cause connection of the drive means for a given document feed path with the motor means upon demand.

15. The document interleaver device of claim 14 in which logic means is associated with the respective document sensing means to cause selected actuator means to engage and disengage their clutches in a predetermined sequence.

16. The document interleaver device of claim 15 in which each of the drive means is provided with a brake as well as a clutch so arranged that upon engagement of the clutch the brake is released and upon disengagement of the clutch the brake is applied.

17. The document interleaver device of claim 11 in which the bins, the means defining document feed paths, and the guide structure for the document feed paths are supported on at least one reference deck tilted out of the vertical to thereby provide a common reference wall for an edge of each document which passes through the device.

18. The document interleaver device of claim 17 in which the axes of rotation of rotating structure of drive means and document separation means are generally perpendicular to the reference deck against which the documents are supported.

19. The document interleaver device of claim 18 in which a second deck is supported parallel to the first by rigid means spacing the two uniformly and support means holds the parallel decks in tilted stable position relative to the ground.

20. The document interleaver device of claim 19 in which guide structure is provided to define said document feed paths, in part comprising guide members having surfaces which direct documents along the document feed path they define and support posts supporting such guide structure, in turn, supported at least by the reference deck.

21. The document interleaver device of claim 20 in which at least some of the support posts extend through and are supported by both of the parallel decks.

22. The document interleaver device of claim 21 in which at least some of the support posts extending through both decks are provided with means to move into and index their positions against one of the decks and having means releasably engagable with means on the second deck to hold them in position.

23. The document interleaver device of claim 22 in which an opening in the second deck through which at least one of the support posts extends is partially closed on the side remote from the reference deck by an overlapping member fixed to the second deck which has a thickness smaller than a circumferential groove in the post positioned to lie beyond the second deck, the end of the post being removed to the bottom of the channel in one area so that at least in one position the post may pass the overlapping member but so that upon rotation of the post the overlapping member is engaged in the circumferential groove.

24. The document interleaver device of claim 23 in which the opposite end of the support post from the circumferential groove is provided with a screwdriver slot to identify its intended orientation relative to the decks and enable rotation thereof by a screwdriver.

* * * * *